US011459681B2

(12) United States Patent
Mitchell

(10) Patent No.: US 11,459,681 B2
(45) Date of Patent: Oct. 4, 2022

(54) BAPTIST FAN LONGARM QUILTING GUIDE

(71) Applicant: Elizabeth Kathleen Mitchell, Long Valley, NJ (US)

(72) Inventor: Elizabeth Kathleen Mitchell, Long Valley, NJ (US)

( * ) Notice: Subject to any disclaimer, the term of this patent is extended or adjusted under 35 U.S.C. 154(b) by 435 days.

(21) Appl. No.: 16/700,156

(22) Filed: Dec. 2, 2019

(65) Prior Publication Data

US 2020/0181820 A1 Jun. 11, 2020

Related U.S. Application Data

(60) Provisional application No. 62/775,413, filed on Dec. 5, 2018.

(51) Int. Cl.
*D05B 97/02* (2006.01)

(52) U.S. Cl.
CPC ..... *D05B 97/02* (2013.01)

(58) Field of Classification Search
CPC ..... D05B 97/02; D05B 11/00; B43L 13/20; B43L 13/201; B43L 13/205; D05C 9/06; A41H 3/002
USPC ..... 33/565
See application file for complete search history.

(56) References Cited

U.S. PATENT DOCUMENTS

| | | | | |
|---|---|---|---|---|
| 2,101,478 | A * | 12/1937 | Reich | B43L 13/20 33/561.3 |
| 6,860,211 | B2 | 3/2005 | Valeriote | |
| 7,255,051 | B2 | 8/2007 | Graham | |
| 7,357,281 | B2 * | 4/2008 | Colucci | A47G 25/28 223/85 |
| 7,730,842 | B1 | 6/2010 | Sebrow | |
| 9,228,280 | B2 | 1/2016 | Bland | |
| D923,493 | S * | 6/2021 | Liu | D10/64 |
| 2007/0251111 | A1 * | 11/2007 | Barry | D05B 11/00 33/562 |

OTHER PUBLICATIONS www.nancysnotions.com dated from Nov. 2018, retrieved from www.archive.org on Jun. 23, 2022, the relevant item on that website being the picture listed under the caption "quilting supplies" (and included as a prior art Figure 3).

* cited by examiner

*Primary Examiner* — Nathan E Durham
(74) *Attorney, Agent, or Firm* — Baldini Law, LLC; Jack Baldini, Esq.

(57) ABSTRACT

A hopping foot guide device for use with a longarm quilting machine to guide the longarm machine's hopping foot sewing needle mechanism across material in an intricate pattern without the need to reset at every turn or otherwise move as the stitching progresses, and capable of accurate repetition.

16 Claims, 4 Drawing Sheets

BAPTIST FAN LONGARM QUILTING GUIDE

MITCHELL

BAPTIST FAN LONGARM QUILTING GUIDE

This application claims priority to Provisional U.S. Patent Application Ser. No. 62/775,413, filed Dec. 5, 2018, which is incorporated herein as if fully set forth.

FIELD OF THE INVENTION

A device is taught for guiding a hopping foot of a longarm quilting machine across material in an intricate pattern without the need to reset at every turn or otherwise move as the stitching progresses, and capable of accurate repetition.

BACKGROUND

Longarm quilting involves the use of a 'longarm' sewing machine used to sew together a quilt top, quilt batting and quilt backing into a finished quilt. A longarm sewing machine is essentially an industrial strength sewing machine with an industrial length sewing head—a 'long arm' that houses the sewing needle, to allow for more manipulation of material than a typical sewing machine. This advent allows for making quilts in significantly less time than hand quilting or use of a traditional sewing machine.

Typically, the longarm quilting machine is equipped with a sewing head, comprising a hopping foot sewing needle mechanism, a worktable, fabric rollers and a frame. Some machines are computer guided—the desired pattern programmed into the machine, and the machine then self-guides the machine head and hopping foot along a desired path. Other machines are hand guided. While it is possible to 'freestyle' a hand guided machine, that takes some serious skill, coordination and experience. Most choose to use some sort of guide ruler to guide either the hopping foot and longarm machine head along the guide, or alternatively, the fabric under the hopping foot and needle, but in either case, guided by the pattern template of the guide ruler used.

There have been many attempts at designing ruler guides for guiding a hopping foot quilting needle. Typically, the most common type to date are edge rulers wherein a hopping foot is guided along an outside edge of a ruler that can be straight, have an angled turn, and/or have curves, but in all cases, the guide is completely along an outside edge. In some embodiments, an entire shape is formed on an outside edge as in the case of a teardrop.

There have been more recent improvements wherein a shape, for example a star or a circle is cutout and a hopping foot needle can follow along an inside edge. In this configuration, however, the template is placed, the hopping foot needle is set in place, the sewing takes place, and then the hopping foot needle must be completely raised and the threads cut in order to replace the template into a new position.

There have been other attempts at simplifying quilting pattern making. For example, U.S. Pat. No. 9,228,280 B2 titled METHOD AND DEVICE FOR SEWING DESIGNS discloses, "a device and method for guiding a hopping foot across material in a desired pattern using a manually positionable longarm sewing machine, the device having a rigid guide arm with opposing first and second planar sides, a plurality of notches formed in the edges of the guide arm, and at least one attachment point for mounting on the material. The attachment point can be a circular opening, and an anchor point in the form of a temporary disc affixed to the material is sized and shaped to be slidably received within the circular opening to provide a pivot point for rotation of the guide arm, and the notches are sized and shaped to slidably receive the hopping foot of the longer sewing machine to guide the hopping foot across the surface of the material." In this case, similar to all of the outside edge templates, the hopping foot is guided along an outside edge, or in an alternative embodiment here, along a simple internal shape, the key being a pivoting guide.

In another example, U.S. Pat. No. 7,730,842 B1 titled QUILTING TEMPLATE AND METHODS discloses, "a template and a method guide a cutting tool during cutting of a quilt block having a selected one of at least two alternate kaleidoscope patterns from a quilting blank having a given pattern of sections seamed together along seam lines intersecting at a common seam origin. The template provides right angle corners and obtuse angle corners for accommodating the alternate kaleidoscope patterns, and includes cutting guides and registration indicators which when registered with seam lines of the quilting blank locate one or more of the cutting guides for cutting one or more segments of the border of a selected kaleidoscope pattern. Indexing of the template and the quilting blank relative to one another relocates the cutting guides for cutting further segments of the border to complete the selected kaleidoscope pattern." In this case, more intricate patterns are envisioned, but the methodology and devices are completely inapposite for the simple mechanical guides applicable here.

In a non-patented reference, Nancy's Notions® discloses a 'Westalee Ruler Foot and Template Set' that describes a series of acrylic template ruler guides that have various grids and angles engraved or embossed on a clear device with various shaped edges and internal cutouts. However, all of the internal cutouts disclosed are simple shapes, such as circles or teardrops and have no direct continuous access, internal to outside edge.

In fact, the only reference that discloses any type of opening such that a hopping foot is permitted to be inserted into the template without being raised (or otherwise the template to be slid up over the shaft of the hopping foot) in order to facilitate stitching inside the shaped opening is as disclosed in the U.S. Pat. No. 9,228,280 B2 referenced above, and as shown in FIG. 7 of that patent. In this teaching, the opening is only limited to allowing the hopping foot to be inserted into a separate template shape, it is not part of the template shape itself, i.e, the opening is a break in the template shape, and the inner template shape is one contiguous inner circumference of a simple shape (in this case, a teardrop)—it does not teach or suggest the possibility of a complex maze-like pattern.

None of the foregoing references, alone or in combination, teach the salient and proprietary features or construction of the present disclosure, and as such, fail to be useful as a longarm quilting guide with an intricate internal edge template capable of guiding a longarm needle through essentially a maze design without requiring lifting or resetting the hopping foot to move to the next design area.

The present disclosure teaches several embodiments that provide a very convenient, inexpensive, solid, stationary, template guide, having an intricate internal design with multiple nested arcs that enable a complex quilting design to be followed, easily, along accurate, repeatable guides, having a plurality of holes providing manual stability and support when in use, with etched guides to allow turns with accurate repetition of pattern.

SUMMARY

The present disclosure teaches embodiments of an apparatus comprising:

a first left straight edge composite comprising a straight outer edge of a predefined length, an inner curved edge, and a plurality of curved fingers emanating from said inner curved edge of said left first straight edge composite; and a second right straight edge composite comprising a straight outer edge of a predefined length, an inner curved edge, and a plurality of curved fingers emanating from said inner curved edge of said second right straight edge composite, said plurality of curved fingers emanating from said inner curved edge of said second right straight edge composite configured to nest in an interlock configuration with said plurality of curved fingers emanating from said inner curved edge of said first left straight edge composite when said first left straight edge composite is joined with said second right straight edge composite by an outer curved edge composite of predefined length and arc; and an outer curved edge composite of predefined length and arc configured to join said first left straight edge composite and said second right straight edge composite at the outermost portion of each such respective inner curved edges, the entire device configured to form a series of nested ascending curved arcs directly accessible from an opening.

In one embodiment, the apparatus taught herein is made from a clear, sturdy material, such as but not limited to, acrylic or plastic. One of skill in the art will be able to readily appreciate other materials that would be desirable based on strength, transparency, durability, flexibility, cost, ease of manufacturing, and other desirable factors.

In other embodiments, the apparatus taught herein is approximately ¼" thick, but in any event, thick enough to prevent a hopping foot needle with which it would be used from jumping out of the track it forms, and thick enough to not break too easily, but not so thick as to be difficult to use.

In one embodiment, the apparatus taught herein has holes and circular etchings placed along both left and right straight edge composites that are useful for fingers to hold the guide in place and stable when used as well as for placing the apparatus at the next point along the continuing pattern to align it properly. The holes are also useful for hanging the guide when not in use.

In one embodiment, the apparatus taught herein has a gridline embossed, etched, or engraved into the structure to make measurements on the fabric easy irrespective of the arcs being stitched. In one embodiment, some gridlines are two inch crosshair grids and some gridlines are dashed arcs that echo the fan pattern of stitching accomplished by the pattern created by the nested arced fingers. In this manner, with the combination of squared gridlines and properly placed curved dashed arc gridlines, the arcs will always be properly placed relative to other sets of arcs and the square edges of the quilt. In a preferred embodiment, three sets of gridlines are embossed, a first set that creates a series of evenly spaced squares, a second set that is merely a centered 'cross-hair', and the third set being the dashed curved arcs that would echo other already stitched or to be stitched arcs.

In one embodiment, the apparatus taught herein has a left straight edge composite that has three curved fingers and a right straight edge composite that has two curved fingers and when joined by an outer curved edge composite, the fingers of each side are configured to nest and create a uniform, alternating, nesting, ascending, series of curved arcs, in a maze-like pattern. In an alternative embodiment, the apparatus taught herein has a left straight edge composite that has two curved fingers and a right straight edge composite that has three curved fingers and when joined by an outer curved edge composite, the fingers of each side are configured to nest and create a uniform, alternating, nesting, ascending, series of curved arcs, in a maze-like pattern.

In one embodiment, the apparatus taught herein, when formed and configured in a preferred embodiment, the formed maze pattern will have an opening such that a hopping foot needle can enter (or exit) the pattern while remaining fully flush against the material it is stitching.

In one embodiment, the apparatus taught herein, when formed and configured in a preferred embodiment, the opening through which a hopping foot needle may enter (or exit) will have an opening parking area where the hopping foot needle begins its stitching to create the nested, ascending, arc pattern.

In one embodiment, the apparatus taught herein creates a path of anywhere from one half to nine-sixteenths of an inch, or wide enough for a hopping foot with which it is to be used to freely traverse the path.

In one embodiment, inner path corners and outer edge corners are rounded to increase durability as well as mimic the rounded nature of the bottom of the hoping foot.

In one embodiment, that apparatus taught herein may be of any configuration, having at a minimum, a left side, a right side, joined by a bridging element, the right side and left side, when joined, configured to have interspaced fingers that form an intricate pattern, the pattern being a path of approximately ½" width to 9/16" to guide a hopping foot needle.

DETAILED DESCRIPTION

Figure 1:
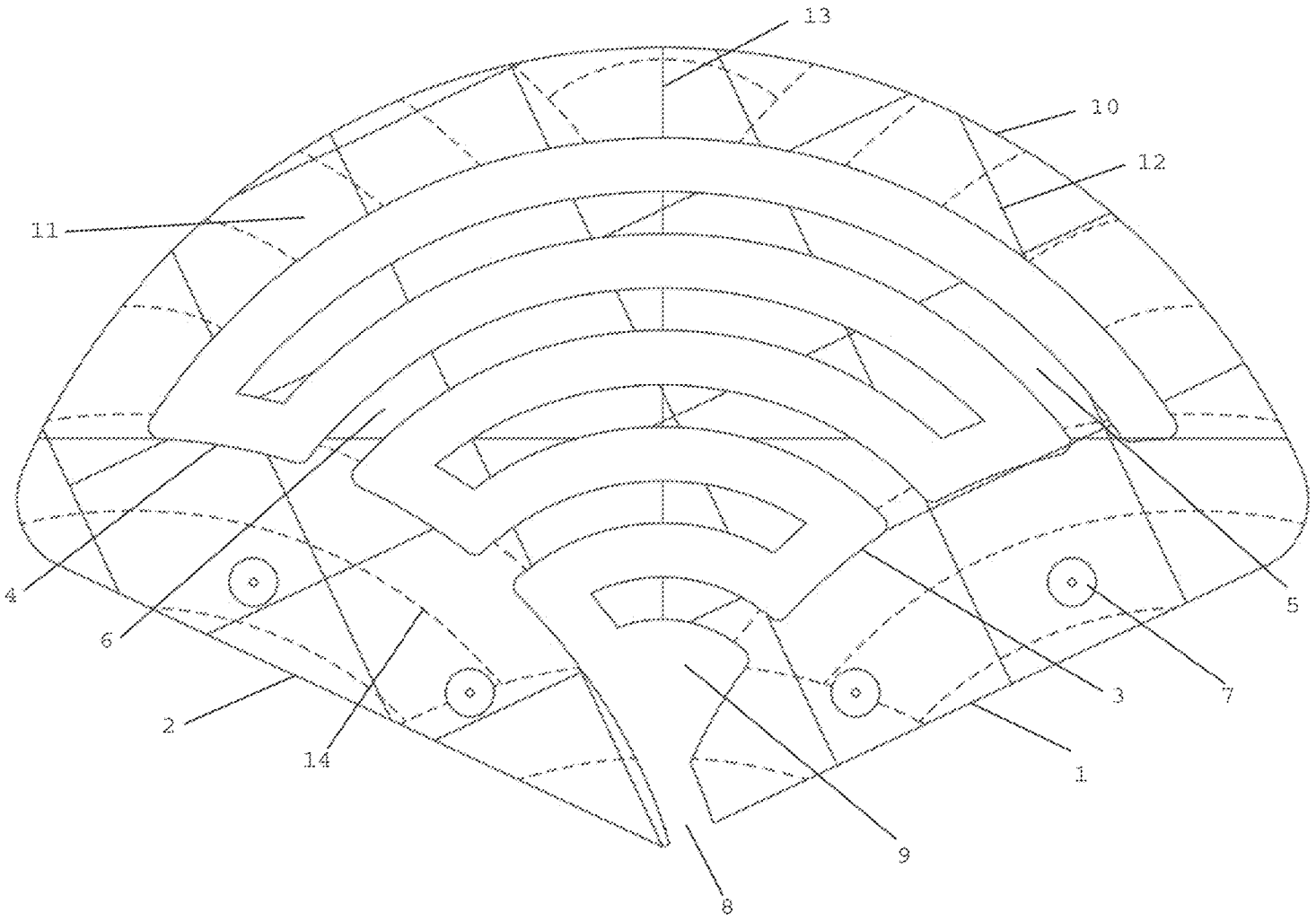
FIG. 1 depicts one embodiment of the present disclosure wherein a first left straight edge composite is depicted with a left straight edge composite with an outer edge (2) of predefined length, an inner curved edge (4) and two curved fingers (6) emanating from the inner curved edge (4); a second right straight edge composite is depicted with a right straight outer edge (1) of predefined length, an inner curved edge (3) and three curved fingers (5) emanating from the inner curved edge (3). Also shown are circular holes inside a circular etching (7) cut into each of the first left and second right straight edge composites, the access opening (8), a hopping foot parking area (9), the outer curved edge composite (11), its outer curved edge (10) and joining the first left and second right straight edge composites at the outermost areas of the inner curved edges of said first left and second straight edge composites. Also depicted are embossing of a grid line (12), a centering cross lines (13), and curved dashed gridlines (14).

For clarity of disclosure, and not by way of limitation, the detailed description of the invention is divided into the following subsections that describe or illustrate certain features, embodiments or applications of the present invention.

Definitions

"first left straight edge composite" as used herein means a formed piece of suitable material, such as but not limited to acrylic or plastic, having a straight left edge of predefined length and an opposite edge from which emanate finger(s) of the same or similar material and the same thickness. The straight left edge and the opposite edge have connecting edges that may or may not be of similar length. The opposite edge, in a preferred embodiment, is curved. The finger(s) in a preferred embodiment are curved.

"second right straight edge composite" as used herein means a formed piece of suitable material, such as but not limited to acrylic or plastic, having a straight right edge of predefined length and an opposite edge from which emanate finger(s) of the same or similar material and the same thickness. The straight right edge and the opposite edge have connecting edges that may or may not be of similar length. The opposite edge, in a preferred embodiment, is curved. The finger(s) in a preferred embodiment are curved.

"outer composite" as used herein means a formed piece of suitable material, such as but not limited to acrylic or plastic, that is configured to join a first left straight edge composite and a second right straight edge composite by attaching at one end to the outer most portion of the opposite edge of the first left straight edge composite and at its other end to the outer most portion of the opposite edge of the second right straight edge composite.

"outer curved edge composite" as used herein means an outer composite that is curved and in a preferred embodiment, the outer curved edge composite is curved to match the curve of the fingers that emanate from both straight edge composites.

"finger" as used herein means a formed piece of composite material of predefined length, curvature and width configured to emanate from an inner edge of either the first left straight edge composite or the second right straight edge composite and further configured to form a pattern when juxtaposed with other fingers.

"hopping foot" as used herein means a particular component of a longarm quilting machine and its sewing head wherein the hopping foot is the sewing needle mechanism that delivers the thread and touches the surface area of the fabric to be quilted.

The System and Method of the Present Invention

An apparatus as described herein may comprise one solid contiguous device with no extraneous or moving parts to jiggle, wobble, get lost, or entangled in material. The apparatus is designed to be used in a static manner, a hopping foot moving around it while it is completely stationary. The apparatus is only moved when the hoping foot is stationary to set up a different area of the fabric to be stitched.

In one embodiment, an apparatus as taught herein comprises a left side straight edge composite, a right side straight edge composite, and a top outer edge forming a triangle fan shape with an outer curved edge—a clam shell shape. Each of the left and right sides have curved fingers that intersperse to form a series of curved, ascending arcs that form a curved maze of sufficient width to be able to guide a hopping foot needle through a beginning to an end, when the left and right sides are joined at one end by the outer top edge. The other ends of the left and right sides are not joined leaving an opening.

Figure 2:
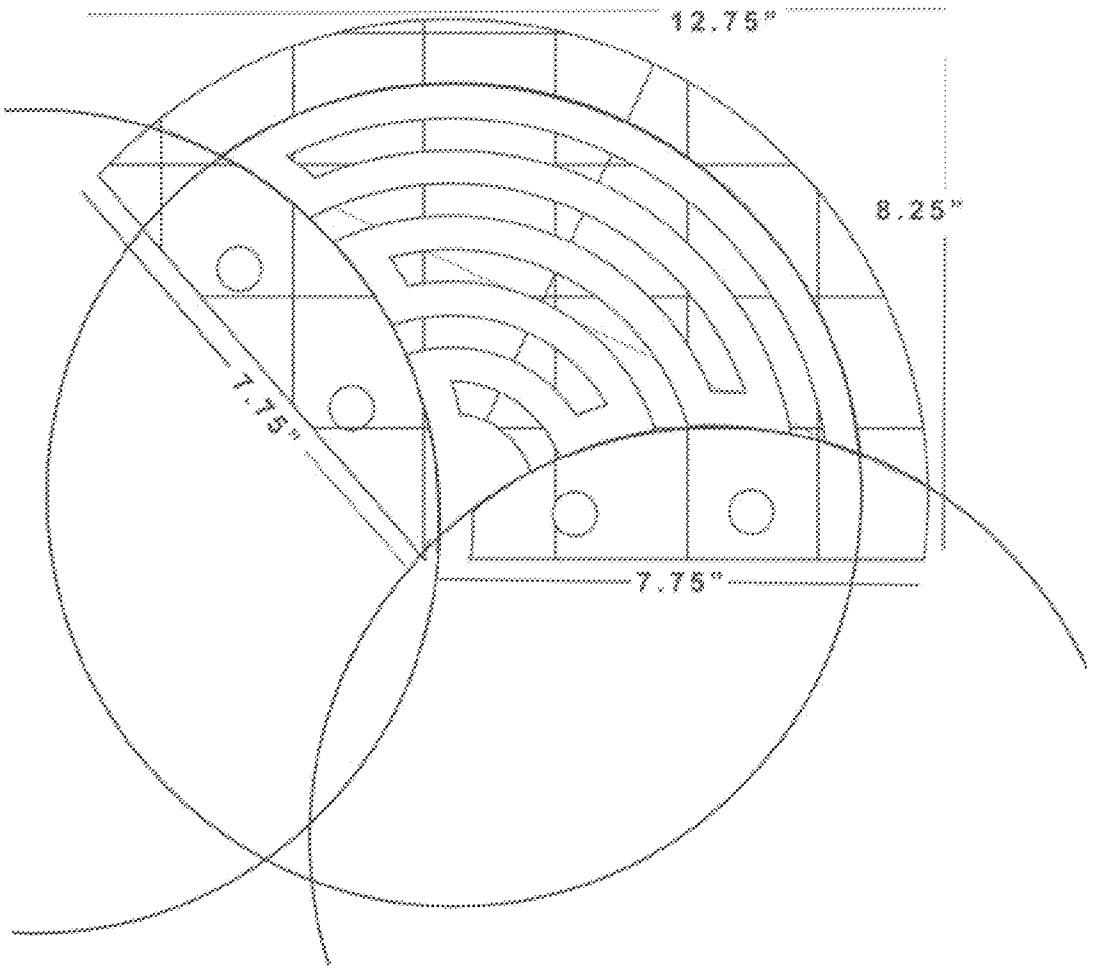
FIG. 2 depicts one embodiment of the present disclosure disclosing some preferred dimensions of an apparatus configured as taught herein
Figure 3:
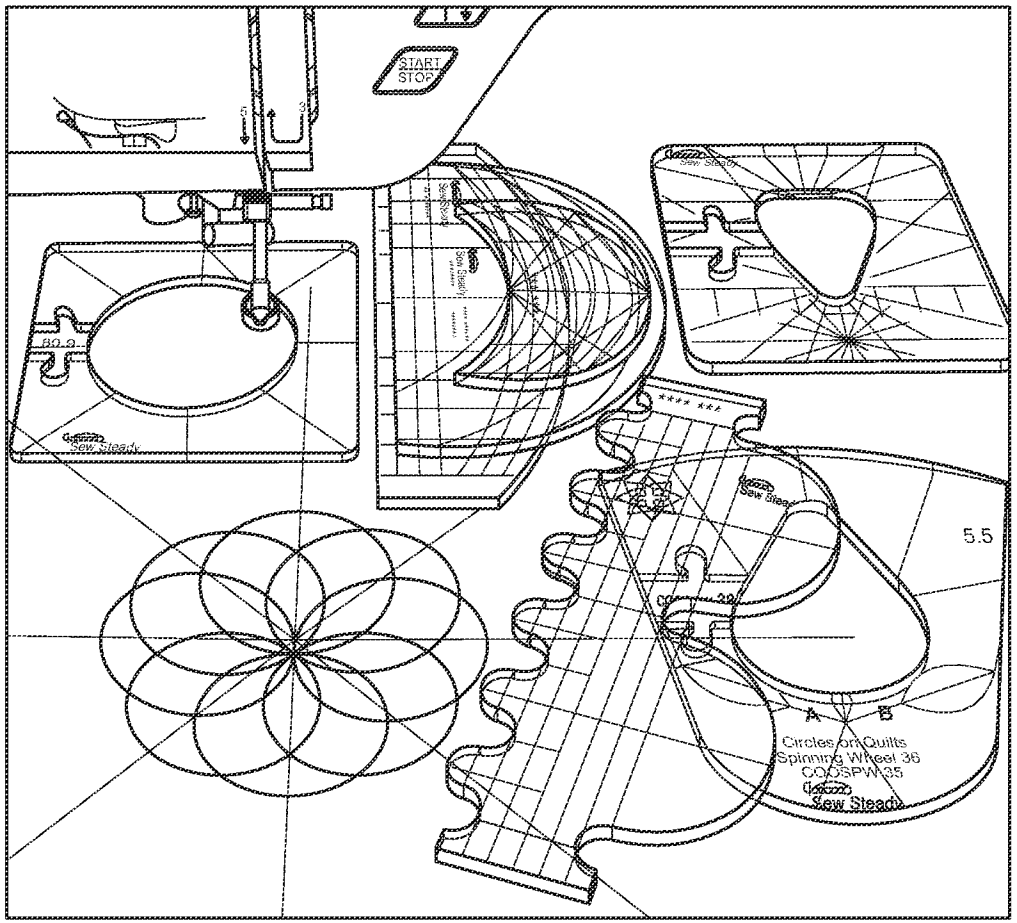
Prior Art FIG. 3
FIG. 3 depicts prior art quilting guides that evidence a plethora of edges along which a hopping foot needle can be guided, some with straight edges, some with curved edges, some with outer edges, some with internal edges, but all missing the salient and proprietary properties of the guide disclosed here.
Figure 4:
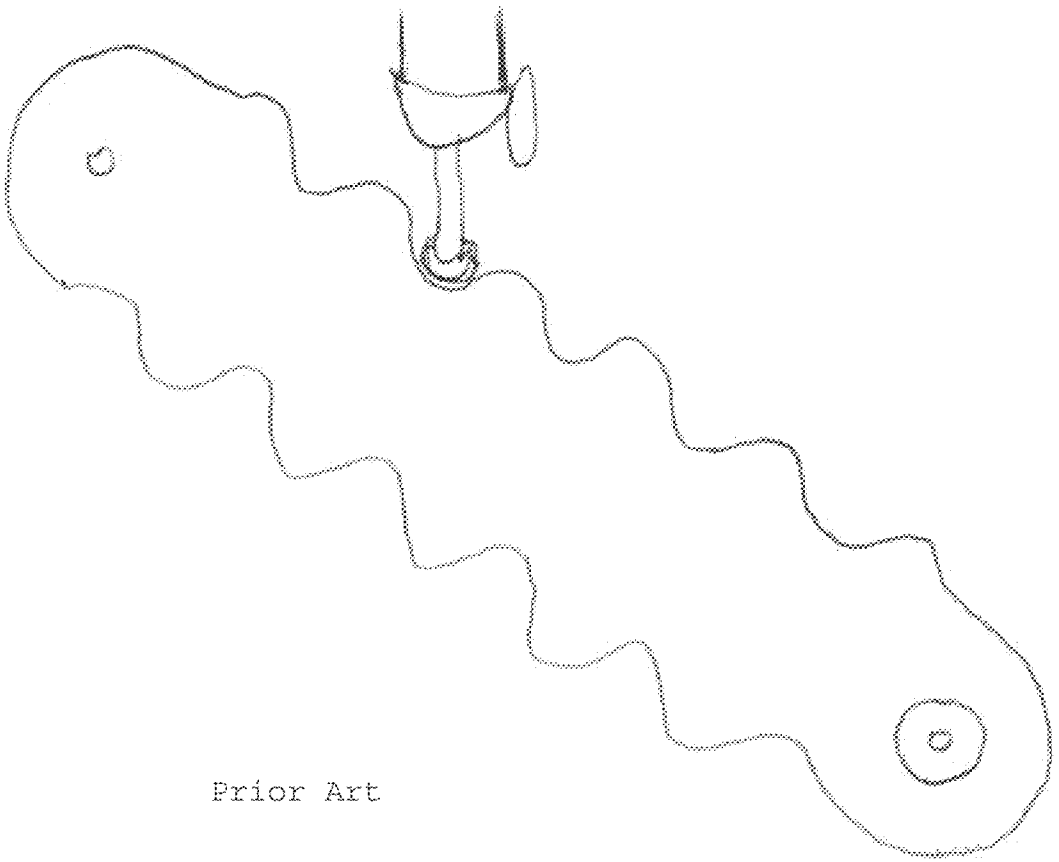
FIG. 4 also depicts prior art, in this case, of a guide that is most commonly used to create a series of nested arc stitchings or circular stitchings that embodies a rotating guide at a specific rotation point, i.e, the guide must move at the same time that the hopping foot needle is moving and stitching.

In a preferred embodiment, the apparatus just described in the preceding paragraph is approximately ¼" thick, i.e., thick enough to be higher than a hopping foot's hop and thick enough to have some inherent strength, without being too thick so as to be unwieldy to use. Referring to FIG. 2, both the first left and second right straight edge composites have outer straight edges that measure 7.75" with an overall width of 12.75" and height of 8.25". The arc of the inner curved edge of both the first left and second right straight edges have an arc the same as that of the uppermost arc formed by the inner curved edge of the outer curved edge composite with each finger then forming similar arcs, descendingly shorter in length to allow for stitches to nest within each consecutive fan. The open path is configured to approximately 9/16" in width to accommodate hopping foots with a diameter of ½" to 9/16".

EXAMPLES

The present invention is further illustrated, but not limited by, the following examples.

An apparatus as described herein is used on the surface of material to be stitched, essentially floating on the surface, manually guided to achieve a design. It is front facing, which improves accuracy.

In one preferred embodiment, the design taught is a typical 'baptist fan' design and in a preferred embodiment of the apparatus as taught, it is directional, manually applying the chosen design with improved efficient progression. In essence, the design follows from a beginning point to an end point, in a non-repeat, continuous path, which eliminates errors in retraced stitches, further allowing a continuous quilted pattern design. Here, when an end point is reached, without a need to lift a hopping foot needle from its ending position, the apparatus can be repositioned for the next repeating design fan, no need to try and replace a needle in a specific spot, because the apparatus can be manipulated around the hopping foot and the grids are strategically placed so that the apparatus can be exactly placed for the next stitching by overlapping with previous stitching or pre-placed design points on the fabric. It should be understood that the apparatus taught here is not limited to producing only 'baptist fan' designs, it can be used to create any number of ascending or descending arc stitching creations limited only by the imagination of the user.

In one preferred embodiment, wherein there are a plurality of finger holes in the right and left straight edge composites, there is provided a manual stability, several maneuver points accessible by either or both hands.

In one preferred embodiment, there is an overall curved fan shape formed, but the non-joined right and left straight edge composites at their straight edge ends, provides an opening which lends balance and stability of design.

In a preferred embodiment, the fingers of each of the left and right straight edge composites are of a pre-defined length and arc, each individually useful in creating continuous linear curves, creating a border or outline, each on a predetermined surface measurement. For example, the fingers may be of 1.5, 3.5, 5.5, 7.5, and 9.5 inches wherein, only one arc may divide evenly across a quilt border. And, because of the ease with which the device can be placed and replaced, without a need to raise the hopping foot needle, and the use of the several etched gridlines, a more accurate border can be created.

In a preferred embodiment, the predetermined measurement of the embossed, engraved or etched grid lines provide guide alignment with surface seams, guidelines to maintain directionality (eliminating the need for the commonly utilized two-inch blocks). This grid system also can indicate the starting point in the placement of the apparatus within a contiguous design path. The dashed arc gridlines can also superimpose on prior stitchings to insure exact placement and the most even of repeating stitchings.

In a preferred embodiment, the apparatus is transparent to facilitate greater visibility on surfaces. The etched, embossed or engraved markings may be of various chosen colors to differentiate between sets of grid lines and/or other important design point features.

In one embodiment, the apparatus described here can be used with regular sewing machines not necessarily designed for quilting if (a) the typical sewing machine is adapted with a ruler foot (essentially an alternate foot designed for ¼" acrylic rulers that is attachable to the sewing needle delivery mechanism to for all intents and purposes transform the sewing needle delivery mechanism into a hopping foot-like mechanism (it is available as either a high shank or low shank as the particular machine requires and is suitable for guiding the sewing needle); and (b) the sewing machine can otherwise accommodate the quilt material and the apparatus here, i.e., has a large enough throat area, sewing platform and strength.

Publications cited throughout this document are hereby incorporated by reference in their entirety. Although the various aspects of the invention have been illustrated above by reference to examples and preferred embodiments, it will be appreciated that the scope of the invention is defined not by the foregoing description but by the following claims properly construed under principles of patent law.

Each and every feature described herein, and each and every combination of two or more of such features, is included within the scope of the present invention provided that the features included in such a combination are not mutually exclusive.

What is claimed is:

1. A longarm quilting guide apparatus comprising:

a first left straight edge composite comprising a straight outer edge of a predefined length, an inner curved edge, and a plurality of curved fingers emanating from said inner curved edge of said first left straight edge composite; and a second right straight edge composite comprising a straight outer edge of a predefined length, an inner curved edge, and a plurality of curved fingers emanating from said inner curved edge of said second right straight edge composite; and an outer curved edge composite of predefined length and arc configured to join said first left straight edge composite and said second right straight edge composite at an outermost portion of each such respective inner curved edges, configured to form a series of nested ascending curved arc paths with said plurality of curved fingers emanating from said inner curved edge of said second right straight edge composite being configured to nest in an interlock configuration with said plurality of curved fingers emanating from said inner curved edge of said first left straight edge composite and said curved arc paths directly accessible from an opening.

2. The apparatus of claim 1, wherein said first left straight edge composite contains two curved fingers, and said second right straight edge composite contains three curved fingers.

3. The apparatus of claim 1 wherein said path is from ½" to 9/16" wide.

4. The apparatus of claim 1, wherein said first left straight edge composite and said second right straight edge composite further comprise at least one hole.

5. The apparatus of claim 1 further comprising embossing or engraving forming at least one grid pattern.

6. The apparatus of claim 5 wherein the at least one grid pattern is of a different color than the material of the overall apparatus.

7. The apparatus of claim 1 wherein said longarm quilting guide apparatus is made from a clear material.

8. The apparatus of claim 1 wherein at least one corner formed by the joining of the left side edge composite and the right side edge composite with the outer curved edge composite are rounded.

9. A longarm quilting guide apparatus comprising:

a first left straight edge composite comprising a straight outer edge of a predefined length, an inner edge, and a plurality of fingers emanating from said inner edge of said first left straight edge composite; and a second right straight edge composite comprising a straight outer edge of a predefined length, an inner edge, and a plurality of fingers emanating from said inner edge of said second right straight edge composite; and an outer composite of predefined length and width having an outer and inner edge configured to join said first left straight edge composite and said second right straight edge composite at an outermost portion of each respective inner edges of said first left and second right straight edge composites, configured to form a series of nested fingers forming a maze path with said plurality of fingers emanating from said inner edge of said second right straight edge composite being configured to nest in an interlock configuration with said plurality of fingers emanating from said inner edge of said first left straight edge composite and said maze path directly accessible from an opening.

10. The apparatus of claim 9, wherein said first left straight edge composite contains two fingers, and said second right straight edge composite contains three fingers.

11. The apparatus of claim 9 wherein said maze path is from ½" to 9/16" wide.

12. The apparatus of claim 9, wherein said first left straight edge composite and said second right straight edge composite further comprise at least one hole.

13. The apparatus of claim 9 further comprising embossing or engraving forming an at least one grid pattern.

14. The apparatus of claim 13 wherein the at least one grid pattern is of a different color than the material of the overall apparatus.

15. The apparatus of claim 9 wherein said longarm quilting apparatus device is made from a clear material.

16. The apparatus of claim 9 wherein at least one corner formed by the joining of the left side edge composite and the right side edge composite with the outer edge composite are rounded.

* * * * *